United States Patent [19]

Ramhorst

[11] 4,201,267

[45] May 6, 1980

[54] WILD WELL CONTROL METHOD AND APPARATUS

[76] Inventor: Louis H. Ramhorst, 538 W. McKinley, Blackwell, Okla. 74631

[21] Appl. No.: 959,690

[22] Filed: Nov. 13, 1978

[51] Int. Cl.[2] ..... E21B 33/03

[52] U.S. Cl. ..... 166/315; 166/86; 166/97

[58] Field of Search ..... 166/315, 75 R, 77, 80, 166/84, 85, 91, 92, 86, 87, 314

[56] References Cited

U.S. PATENT DOCUMENTS

| | | | |
|---|---|---|---|
| 1,664,643 | 4/1928 | Rasmussen | 166/92 |
| 1,828,124 | 10/1931 | Bower | 166/92 |
| 1,978,378 | 10/1934 | Walker | 166/92 |
| 2,788,856 | 4/1957 | Ortloff | 166/92 |
| 3,603,385 | 9/1971 | Jones | 166/75 X |

*Primary Examiner*—Stephen J. Novosad
*Attorney, Agent, or Firm*—Jack N. Shears

[57] ABSTRACT

Uncontrolled fluid flow from an open cased well is closed off by (a) inserting a probe tool having an elongated lower cylindrical member slidably fitable inside the casing (the member having a seal circumscribing its diameter and a valve about its upper end) into the end of the casing such that the flow is shut off, (b) fastening the valve to the end of the casing, (c) withdrawing the probe, and (d) shutting off the valve.

7 Claims, 2 Drawing Figures

WILD WELL CONTROL METHOD AND APPARATUS

BACKGROUND OF THE INVENTION

1. Field of the Invention

The invention relates to closing off uncontrolled fluid flow from an open cased well. Uncontrolled fluids flowing from the well can include artesian water, crude oil, gas, mud, or the like.

2. Brief Description of the Prior Art

The drilling, completing, servicing, and workover of oil and gas wells as well as water wells is a well known and widely practiced art in the United States. Concise descriptions of present practice are found in Wells Servicing and Workover, Introduction of Oil Well Service and Workover, a Home Study Course issued by the Petroleum Extension Service, the University of Texas at Austin, Austin, Texas (1971) and Buzarde Jr. et. al., Production Operations Course 1—Well Completions, Society of Petroleum Engineers of the American Institute of Mechanical Engineers (1972).

A continuing problem in the drilling, completion and workover of such wells, particularly oil and gas wells, is the initiation of uncontrolled fluid flow from an open cased well. This happens in drilling operations from encounter of unexpected gas kick or unexpected penetration into a formation holding fluids such as gas, water, or oil at high pressure. In the drilling of water wells, artesian water also may result in uncontrolled fluid flow from an open cased well.

If fluids are flowing from an open cased well in an uncontrolled manner, it is extremely important that the well be brought under control at the earliest possible time in order to prevent wasteage of natural resources, to prevent environmental damage, for the safety of operating personnel, and to prevent damage to equipment.

The inventor is aware of two prior art patents involving different approaches to the problem.

Specifically, U.S. Pat. No. 1,664,643 relates to a capping device for oil wells which utilizes flow of the oil to hold it in position ready to be forced down in an engaging position.

A later patent, U.S. Pat. No. 2,788,856, discloses another approach involving use of a probe having inflatable packer for insertion into the casing.

Though both of these approaches have merit, improved tools and methods are desirable for the controlling of uncontrolled fluid flow from open cased wells, i.e., wild wells.

OBJECT OF THE INVENTION

An object of the invention is to provide a method for the controlling of uncontrolled fluid flow from an open cased well.

Another object is to provide apparatus for the control of uncontrolled fluid flow from an open cased well.

SUMMARY OF THE INVENTION

According to a presently preferred embodiment of the invention uncontrolled fluid flow from an open cased well is closed off by (a) inserting a probe tool having elongated lower cylindrical member slidably fittable inside the casing (the member having a seal about its lower end and a valve about is upper end) into the end of the casing such that the well is shut off, (b) moving the valve into contact with the end of the casing and fastening the valve to the end of the casing, (c) withdrawing the probe, and (d) shutting off the valve.

According to another presently preferred embodiment of the invention, uncontrolled fluid flow from an open cased well having a drill string therein is closed off by (a) inserting a vertically elongated probe tool slidably fittable inside the casing, having a seal about its lower end and a valve about its upper end, having a center bore along its vertical center axis slidably fittable about the drill string, into the casing and around the drill string such that the well is shut off, (b) moving the valve into contact with the end of the casing and fastening the valve to the end of the casing, (c) withdrawing the drill string through the center bore until the last joint of the drill string is within the center bore, (d) withdrawing the last joint of the drill string and the probe tool, and (e) shutting off the valve.

DETAILED DESCRIPTION OF THE DRAWINGS

Figure 1:
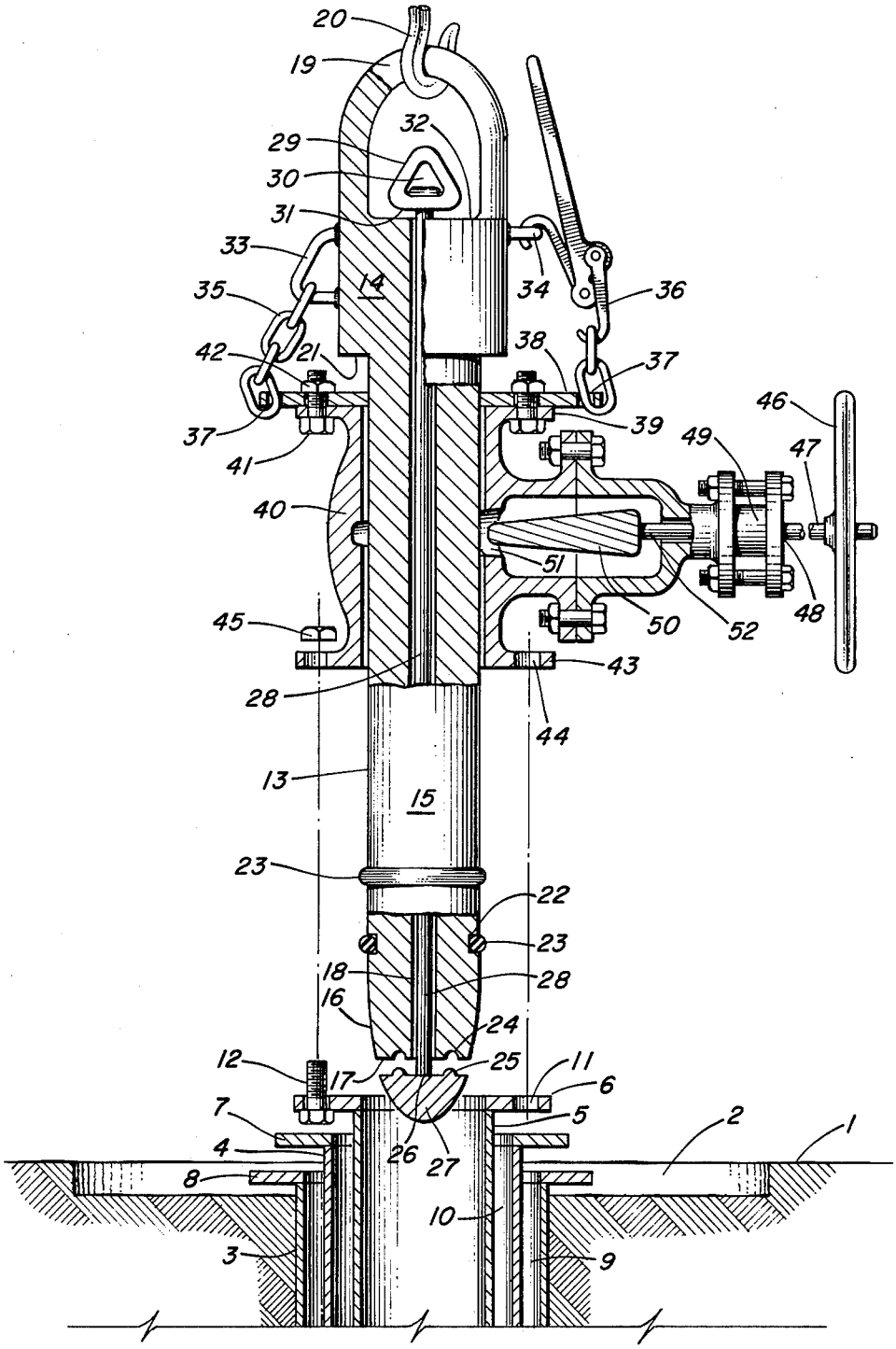
FIG. 1 illustrates a semi-schematic vertical cross section of an embodiment of the probe tool, valve, and supplemental equipment of the invention positioned above a cased well bore and ready for insertion.

Referring to FIG. 1, illustrating one presently preferred embodiment of the invention, a vertical cross section of the upper portion of a conventional open cased well is shown penetrating the earth. Thus, situated in the cellar 2 (a shallow hole around the well head) in the earth 1 is conductor casing 3 which is driving down to consolidated material. Annulus 9 between conductor casing 3 at its upper end and the outer circumference of the hole drilled downward from the surface conductor at lower levels is filled with cement at lower levels to cement surface casing 4 in place and bind it to the earth to withstand upward and downward stress. In turn, the annulus 10 formed between surface casing 4 and the oil string casing 5 also has cement in its lower portion binding the oil string casing to the earth formation. Flanges 6, 7, and 8 are employed as shown at the top of the respective casing 3, 4, and 5. The upper flange 6 has holes 11 for passage of fastening bolts 12 therethrough.

Probe tool 13 having an upper body member 14 of sufficient diameter to be non-insertable in the casing and a lower cylindrical shaped, vertically elongated probe member 15 of a diameter such as to be slidably fittable into the drill string casing 5 is situated above the upper end of the open cased well. The probe member 15 has a generally rounded lower end 16 terminating in a flat shoulder 17. It also has a bore 18 along its center vertical axis from its lower end to its upper end, a hook receiving means 19 in its upper end for receiving hook 20 of a derrick crane (not shown), and at its upper end, an abutting shoulder 21 where the upper body member and a probe member meet. The probe member 15 has receiving slots 22 for the ring seals 23 and receiving slot 24 for ring seal 25 on the stem valve 26. The stem valve 26 compromises lower valve head 27, operating stem 28, and lifting eye 29 forming lifting hook receiving means 30 and lower shoulder 31 for abutment against abutment surface 32 of the upper body 14 of the probe tool 13.

The upper body member 14 of probe tool 13 also has attachment ring 33 and holder ring 34 for fastening carrier chain 35 and boomer 36 to slots 37 of valve carrier 38 shown attached to the upper flange 39 of valve 40 by means of bolts 41 and nuts 42.

Valve 40 also has lower flange 43 having holes 44 alignable with holes 11 and flange 6 of the drill string casing and is fastenable thereto by bolts 12 and nuts 45. The valve is of the type providing for an open bore when the valve is open and is closeable by means of turning wheel 46 connected through stem 47 inserted through bore 48 in housing member 48 of the valve containing a mechanism for forcing closing probe 50 into receiving slot 51 by means of connecting member 52.

Figure 2:
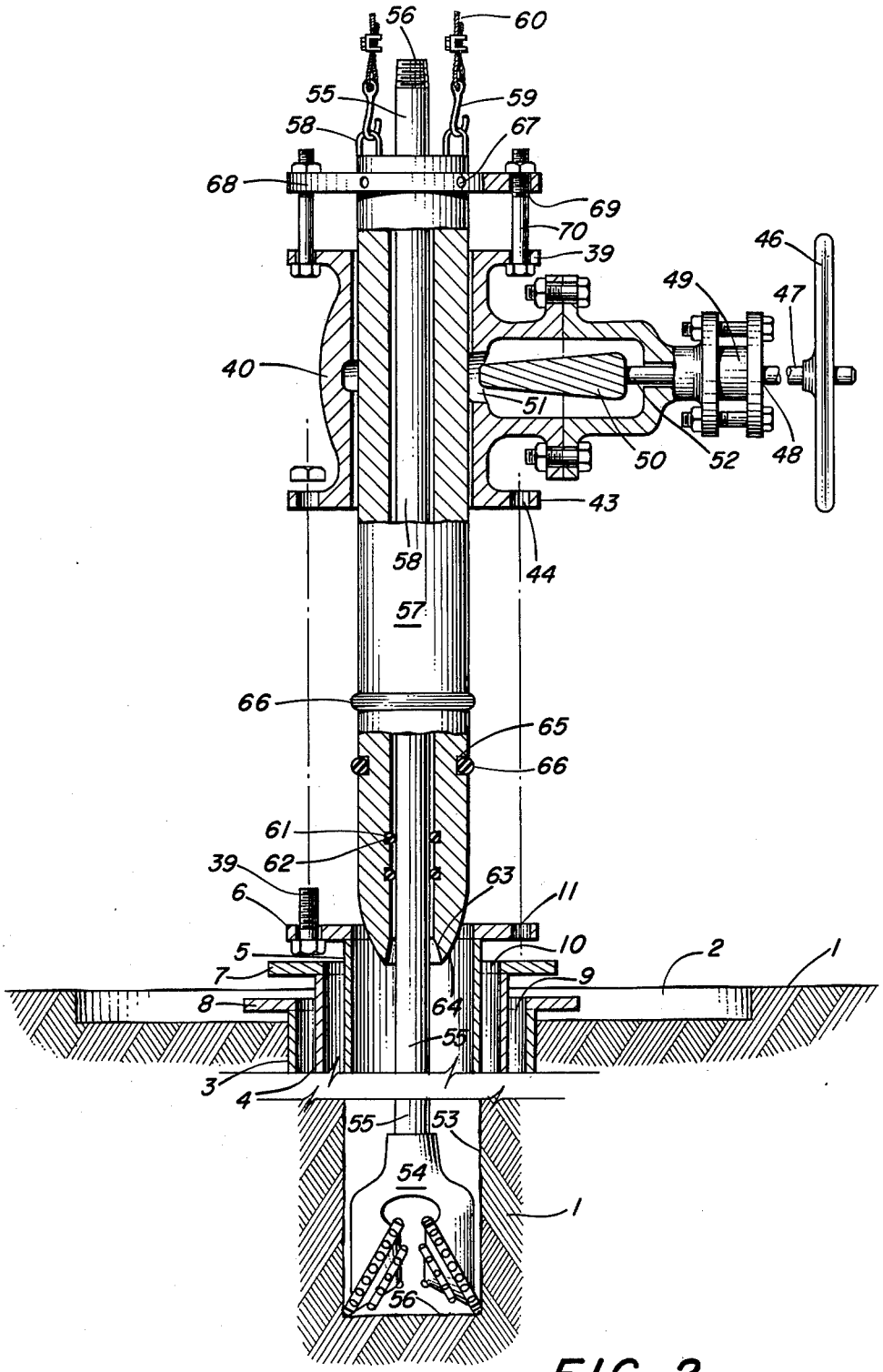
FIG. 2 shows a semi-schematic vertical cross section of another embodiment of the probe tool, valve, and supplemental equipment of the invention positioned above a cased well bore having the drill stem still implaced therein, the apparatus ready for insertion to control the well.

Referring now to FIG. 2, illustrating another presently preferred embodiment of the invention, a vertical cross section of the upper portion and the lower uncased portion of a conventional open cased well penetrating the earth is shown.

Situated in the cellar 2 (a shallow hole around the well head) in the earth 1 is conductor casing 3 which is driven down to consolidated material. Annulus 9 between conductor casing 3 at its upper end and the outer circumference of the bore hole drilled downward from the surface conductor at lower levels is filled with cement at lower levels to cement surface casing 4 in place and bind it to the earth to withstand upward or downward stress. In turn annulus 10 formed between surface casing 4 and the oil string casing 5 also has cement in its lower portion binding the oil string casing to the earth formation through which it passes. Flanges 6, 7, and 8 are situated as shown at the top of the respective casing 3, 4, and 5. The upper flange has holes 11 for passage of fastening bolts to attach valve 40 which has features as described and numbered previously.

Shown in the lower section is uncased borehole 53 with drill bit 54 and drill stem 55 on the bottom 56 of the well.

Drill stem 55 extends upward through the surface and is uncoupled showing end coupling 56.

Probe tool 57 is of cylindrical shape and of a diameter such as to be slidably insertable into the drill string casing 5 is situated above the upper end of the cased well. The probe tool has a center bore 58 along its center vertical axis from its lower end to its upper end. Its upper end has hook receivers 58 for receiving hooks 59 from lifting lines 60. The center bore 58 has receiving slots 61 for ring seals 62 for effecting fluid tight seal about drill stem 55.

The lower end of the probe tool 57 has sloping shoulder 63 for easy engagement on the upper end of the drill stem and sloping shoulder 64 for ready engagement in the oil string casing 5.

The probe tool 57 has receiving slots 65 and sealing rings 66 about its outer circumference for sealing engagement within oil string casing 5 upon insertion therein.

The probe tool has removable attachment pins 67 for attaching holding collar 68 near its upper end. Holding collar 68 has attachment holes 69 for receiving attachment means 70 for holding valve 40 in place by means of flanges 6 thereon.

The fully opening valve 40 has lower flange 43 with holes 44 suitably arranged for matching with holes 11 in flange 6 for attachment thereto.

PREFERRED EMBODIMENTS OF THE INVENTION

In operation in accord with the embodiment shown in FIG. 1, the probe 15 with the stem valve 26 in the open position is lowered into the open cased well whereby the ring seals 23 engage the side of the drill string casing 5 providing a seal. Thereupon, the stem valve 26 is lifted shutting off flow of fluids, the valve is lowered (if necessary), the valve is attached to the drill string flange 6 by means of flange 43, the probe tool is withdrawn, and the valve 40 is closed shutting off the flow from the well.

In accordance with a presently preferred embodiment of the invention, one exemplification of which is shown in FIG. 1, the probe tool, is employed to shut off uncontrolled fluid flow from an open cased well. Thus, the probe tool in this embodiment has an upper body of sufficient diameter to be non-insertable into the well casing and a lower cylindrical shaped vertically elongated probe member of a diameter such as to be slidably fittable into the drill string casing of the open cased well. This embodiment is preferrably employed when no drill string is in the well.

In operation, according to an embodiment shown in FIG. 1, the probe tool 13 is suspended from receiving hook 20 of a derrick crane by means of hook receiving means 19 on its upper end above the upper end of the open cased well having uncontrolled fluid flow therefrom.

The valve having a lower flange 43 in turn having holes 44 alignable with holes 11 and flange 6 of the drill string casing and fastenable thereto by bolts 12 and nuts 45 is attached by means of its upper flange 39 and by means of bolts 41 and nuts 42 to holder ring 34. The holder ring 34 is fastened by means of slots therein 37, carrier chain 35, and boomer 36 to attachment ring 33 and holder ring 34 to the upper body member 14 of the probe tool 13.

The valve 40 is of the type providing for an open bore when the valve is open and is closeable by means of turning wheel 46 connected through stem 47 inserted through bore 48 in housing member 49 of the valve, containing a mechanism for forcing closing probe 50 into receiving slot 51 by means of connecting member 52. The valve 40 also has a lower flange 43 having bolts 44 alignable with holes 11 and flange 6 of the drill string casing, and is fastenable thereto by bolts 12 and nuts 45.

In operation, the stem valve 26 comprising lower valve head 27 operating stem 28 and lifting eye 29 is in a downward or open position.

Thereupon, probe tool 13 is lowered such that its vertically elongated probe member slides into drill string casing 5 as guided therein by generally rounded lower end 16 and the rounded end of valve head 27. Upon engagement of sealing rings 23 into the drill string casing 5, fluid flow between the elongated probe member 15 and the enternal diameter of drill string casing 5 is stopped.

Lowering is continued until flange 43 contacts flange 6. Thereupon, holes 44 and 11 are aligned, and the flanges are securely attached to each other by means of bolts 12 and nuts 45. A sealing gasket can be placed there between to prevent any fluid leakage between the flanges.

Thereupon, stem valve 26 is closed by lifting eye 29, consequently urging lower valve head 27 against shoulder 17 completely shutting off flow of fluids from the well through the annulus between the operating stem 28 and the surface of bore 18.

Bolts 41 and nuts 42 are removed detaching valve carrier 38 from upper flange 39 of valve 40.

At this point, valve 40 is securely attached to drill string casing 5 and the assembly comprising the probe tool 13 attached to valve carrier 38 is withdrawn.

Upon withdrawal of the probe tool, fluid flow is again evident from the well. However, such fluid flow is readily shut off by closing valve 40 by turning turning wheel 46 consequently forcing closing probe 50 into receiving slot 51 and shutting off flow from the now controlled well.

With the well now controlled, completion of the well and various other operations can be carried out as are well known to those skilled in the art.

The probe tool can be fabricated of any suitable material. Presently, high strength steel is preferred as a material for fabrication.

The valve is shown attached and attachable by means of flanges and bolts. However, it is to be understood that threaded connections, welding, and the like can also be employed.

Though attachment of the valve to the upper body member of the probe tool is shown by means of attachment rings, holder rings, and fastening carrier chain and boomers, any other suitable means of detachable attachment can be employed.

The O rings are shown as sealing means between the casing and the probe tool. However, it is to be understood that any other suitable sealing means can be employed including expandable metal seals, chevron rings, and the like as are well known to those skilled in the art.

The valve 40 can be any conventional valve having a full opening center bore. According to one presently preferred embodiment, a hydraulically operated blowout preventor valve which is closeable upon application of hydraulic pressure is employed. It is only necessary that the valve have a full bore opening in the open position such that the probe can be inserted there through.

According to one embodiment, the probe is lowered into the well by means of its inherent weight. However, the probe can also be forced into the drill string casing in situations where high pressure fluids are flowing from the well by means of cinching tackles, downwardly acting hydraulic rams, downwardly operating levers, screws, and the like according to known engineering know how.

In accordance with another embodiment, as exemplified by FIG. 2, a mode of this invention particularly useful for wells having uncontrolled flow of fluids therefrom and having drill string therein is described as follows.

Probe tool 57 is of cylindrical shape and of a diameter such as to be slidably insertable into the drill string casing 5. The probe tool has a center bore 58 along its vertical axis from its lower end to its upper end.

In accordance with this mode of the invention, the probe tool is lowered by means of lifting line connecting to hook receivers 58 by means of receiving hooks 59 first over end coupling 56 of drill stem 55 and then into drill string casing 5.

Prior to lowering, fully opening valve 50 is mounted about and on the probe tool by means of holding collar 68 attached to the probe tool by removeable attachment pins 67, and bolts 70.

Upon lowering into place into oil string casing 5, O rings 65 shut off flow of fluids between the casing diameter and the probe tool while O rings 62 shut off flow of fluids between the probe tool and drill string.

Upon lowering into place such that flange 43 contacts flange 6, the valve flange is secured to the casing flange by means of bolts 39 through holes 11 and 44. Suitable sealing means can be employed between the flanges.

Thereupon, pins 67 are pulled allowing probe tool 57 to move freely up and down through the valve and valve carrier 68. Valve carrier 68 is moved into proximity with flange 37 of the valve and bolts 70 are removed.

Thereupon, probe tool 57 is lowered to proximity with bit 54 and the drill string is pulled from the well section by section as the probe tool is raised with the bit. Alternatively, the probe tool is lowered one section of drill string at a time as the drill string is pulled and removed.

When the last stem of drill string is reached, the probe 57 and last stem of drill string including the bit are pulled from the well, and the valve is closed shutting off flow from the well. The carrier ring 68 can either be removed concurrently with the last stem of drill string and probe or can be removed after the flow of fluids is shut off with the valve 40.

Exemplification of this invention has been made in order to more fully describe it and its mode of operation to those skilled in the art. However, such exemplification is not limiting and the invention is limited only by the claims or equivalent methods or structures in the light of the complete application.

I claim:

1. A method for controlling uncontrolled fluid flow from an open cased well comprising:

(a) inserting a probe tool having an elongated lower cylindrical probe member slideably fitable inside the casing (the member having a seal circumscribing its diameter and a valve about its upper end) into the end of the casing such that the flow is shut off, (b) fastening the valve to the end of the casing, (c) withdrawing the probe, and (d) shutting off the valve;

wherein the probe tool has an upper body member of sufficient diameter as to be uninsertable in the casing, wherein the upper body has attachment means for a lifting means therefor, wherein the probe member seal is about the lower circumference of the probe member and is adapted to provide a seal between the interior circumference of the probe member and the casing, and wherein the valve about the upper end of the probe member is situated about the seal and is adapted to be sealably fastenable to the upper end of the casing; wherein the probe tool has a bore along its vertical axis, a flattened shoulder at its lower end, a stem valve situated in the bore having an upper lifting attachment means, an elongated vertical stem, and a lower valve head sealable upon upward urging against the flattened shoulder at the lower end of the probe tool, the closed valve head and lower end of the probe tool defining a bullet shape; and wherein the upper body of the probe tool has attachment means for attaching a lifting mechanism adaptable for lifting a detachable valve carrier attached to the upper end of the valve.

2. A method for controlling uncontrolled fluid flow from an open cased well comprising:

(a) inserting a probe tool having an elongated lower cylindrical probe member slideably fitable inside the casing (the member having a seal circumscribing its diameter and a valve about its upper end) into the end of the casing such that the flow is shut off,
(b) fastening the valve to the end of the casing,
(c) withdrawing the probe, and
(d) shutting off the valve; wherein
(e) the open cased well has a drill stem protruding therefrom,
(f) wherein the probe tool comprises a cylindrical probe member slideably fitable inside the casing,
(g) wherein the probe tool has a bore along its center axis sized to be slideably fitable about the drill stem,
(h) wherein the probe tool is inserted over the drill stem prior to insertion into the casing,
(i) wherein the probe tool has a seal about its outer diameter and a seal about the bore so as to provide seal between the tool and the casing and drill stem respectively,
(j) wherein the upper end of the probe tool has receivers for lifting means,
(k) wherein the probe tool has detachable attachment means for attaching a holding collar about its upper end, the holding collar providing means for holding the valve in place about the probe tool,
(l) wherein the drill stem is withdrawn except for the bottom joint through the probe tool prior to withdrawing the probe tool, and
(m) wherein the probe tool and bottom joint of drill stem are withdrawn from the valve concurrently.

3. Apparatus for closing off uncontrolled fluid flow from the casing of an open cased well comprising:
(a) a probe tool having an upper body member of sufficient diameter as to be uninsertable in the casing;
(b) the upper body having attachment means for a lifting means therefor,
(c) the tool having a lower cylindrically shaped, vertically elongated probe member of a diameter to be slideably fitable in the casing;
(d) the probe member having a sealing means situated about the lower circumference thereof, the sealing means adapted to provide a seal between the interior circumference of the casing and the exterior lower circumference of the probe means;
(e) situated about the upper portion of the probe member above the sealing means, a valve means having an open bore slideably fitable about the probe member and adapted to be sealably fitable to the upper end of the casing; wherein the probe tool has a bore along its vertical axis, a flattened shoulder at its lower end, a stem valve situated in the bore having an upper lifting attachment means, an elongated vertical stem, and a lower valve head sealable upon upward urging against the flattened shoulder at the lower end of the probe tool, the closed valve head and lower end of the probe tool defining a bullet shape.

4. The apparatus of claim 3 wherein the upper body of the probe tool has attachment means for attaching a lifting mechanism adaptable for lifting a valve carrier attached to the upper end of the valve means.

5. The apparatus of claim 4 wherein a seal means is affixed between and to either the upper surface of the stem valve head or the lower surface of the flattened shoulder at the lower end of the probe tool, wherein a plurality of O-ring receptacles are situated in the side of the lower portion of the elongated probe member and wherein the lower end of the valve member has a flange with holes matching flange holes at the upper end of the well casing.

6. Apparatus for closing off uncontrolled fluid flow from the casing of an open cased well having a drill stem projecting therefrom comprising:
(a) a cylindrical probe tool sized to be slideably insertable in the casing and having a bore along its center vertical axis sized to be slideably fitable over the drill stem;
(b) the probe tool having about its lower outer diameter seal means for effecting seal between the tool and the casing upon insertion therein;
(c) the probe tool bore having seal means in its center bore for effecting seal between the tool and the drill stem upon insertion thereover;
(d) the probe tool having a detachable collar about its upper circumference for retention of a valve about its upper circumference.

7. The apparatus of claim 6 wherein:
(a) the probe tool has receivers for lifting attachments on its upper end, and
(b) the shoulder between the lower end of the outer circumference and the lower end of the bore are rounded.

* * * * *